US005845963A

United States Patent [19]

Huang

[11] Patent Number: 5,845,963

[45] Date of Patent: Dec. 8, 1998

[54] WALKING CHAIR INCORPORATIVE OF A ROCKING CHAIR

[75] Inventor: Li-Chu Chen Huang, Chiayi, Taiwan

[73] Assignee: Discovery International Co., Ltd., Tortola, Virgin Islands (Br.)

[21] Appl. No.: 2,384

[22] Filed: Jan. 2, 1998

[51] Int. Cl.[6] ..... A47D 11/00

[52] U.S. Cl. ..... 297/131; 297/5; 482/68

[58] Field of Search ..... 297/5, 131; 482/68; 280/87.051

[56] References Cited

U.S. PATENT DOCUMENTS

| | | | |
|---|---|---|---|
| 134,668 | 1/1873 | Henrichs | 297/131 |
| 140,900 | 7/1873 | Downing | 297/131 X |
| 174,793 | 3/1876 | Erikson | 297/131 X |
| 529,359 | 11/1894 | Bradish | 297/131 |
| 1,250,045 | 12/1917 | Steinbach | 297/131 |

*Primary Examiner*—Peter R. Crown
*Attorney, Agent, or Firm*—Bacon & Thomas

[57] ABSTRACT

A walking chair having a pair of opposed arcuate side frames and a front rod pivotally connected with corresponding first distal ends of the arcuate side frames, a rear rod opposed to the front rod and pivotally connected with corresponding second distal ends of the arcuate side frames, such that when a folding device which is provided at joints of the front rod and the first distal ends of the arcuate side frames and of the rear rod and the second distal ends of the arcuate side frames is activated, the arcuate side frames are able to be folded and then positioned in place to allow the arcuate side frames to engage with the ground to allow a walking chair converted into a rocking chair.

3 Claims, 7 Drawing Sheets

40
42
41
11
111
113
115
112
110
114
17
421
16
422
A
B
165
161
441
44
43
162
163
164
18
15
13

WALKING CHAIR INCORPORATIVE OF A ROCKING CHAIR

BACKGROUND OF THE INVENTION

1. Field of the Invention

The present invention relates to a walking chair, and more particularly to a walking chair incorporative of a rocking chair. Two symmetrically opposed arcuate bottom frames of the walking chair are able to be folded downward relative to a seat thereof and thus the walking chair is converted into a rocking chair, such that a baby is able to rock back and forth in a safer structure.

2. Description of Related Art

Cribs have been developed for babies to securely and safely sit therein and to learn how to walk. A conventional crib generally has a plurality of wheels rotatably mounted under a bottom frame thereof and in contact with the ground and an upper frame rigidly mounted onto the bottom frame for limiting and protecting the baby seated therein. With such a constructed crib, the baby is able to freely move around with its feet in contact with the ground, such that the baby is able to learn how to move with its feet. However, once the baby is tired of such a constructed crib and wants something more exciting, e.g, a rocking horse, parents will have to pay for one to satisfy the baby's need. However, it is not safe for a baby to ride a rocking horse alone, especially when the baby is still not able to walk all by itself. It is notable that the rocking horse usually has no protection for the baby when the baby is riding thereon, so it is very dangerous for a baby to ride a rocking horse without supervision. The constant supervision of the baby by its parents is so demanding and tiresome that their attention may slip eventually, whereby an accident may occur.

In order to solve the aforementioned problems, the present invention provides an improved walking chair which is able to be rockable when required to mitigate and/or obviate the aforementioned problems.

SUMMARY OF THE INVENTION

One object of the present invention is to provide a walking chair incorporative of a rocking chair. The walking chair of theinvention allows a baby to learn how to walk and enables the baby to enjoy rocking therein.

Another object of the present invention is to provide a walking chair of which two opposed side frames are foldable and configured to have an arcuate shape, such that a baby is able to rock in the chair of the invention when the two opposed side frames are pivoted downward relative to a seat thereof.

Other objects, advantages and novel features of the invention will become more apparent from the following detailed description when taken in conjunction with the accompanying drawings.

DETAILED DESCRIPTION OF THE PREFERRED EMBODIMENT

Figure 1:
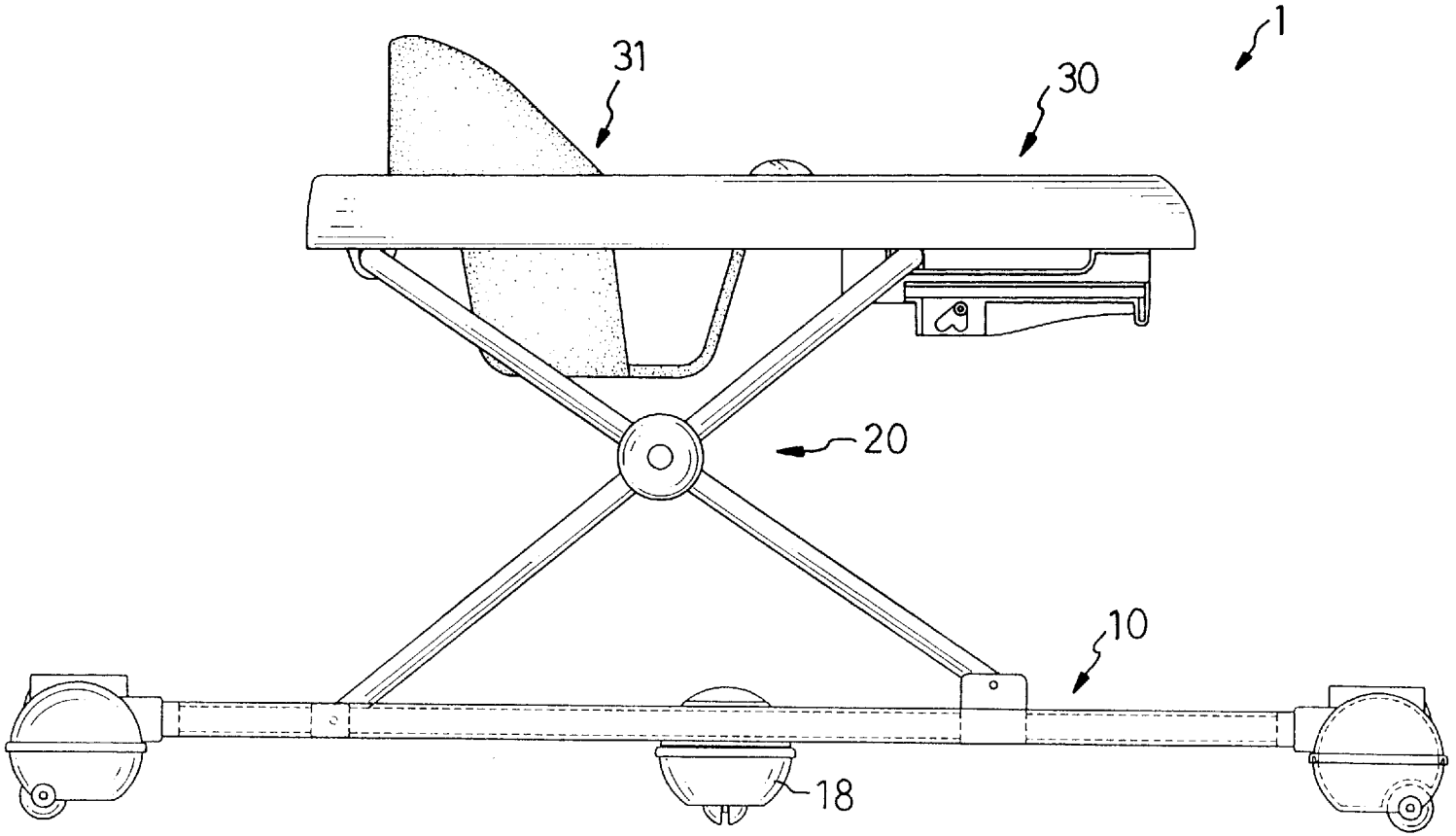
FIG. 1 is a side view of a walking chair of the invention.
Figure 2:
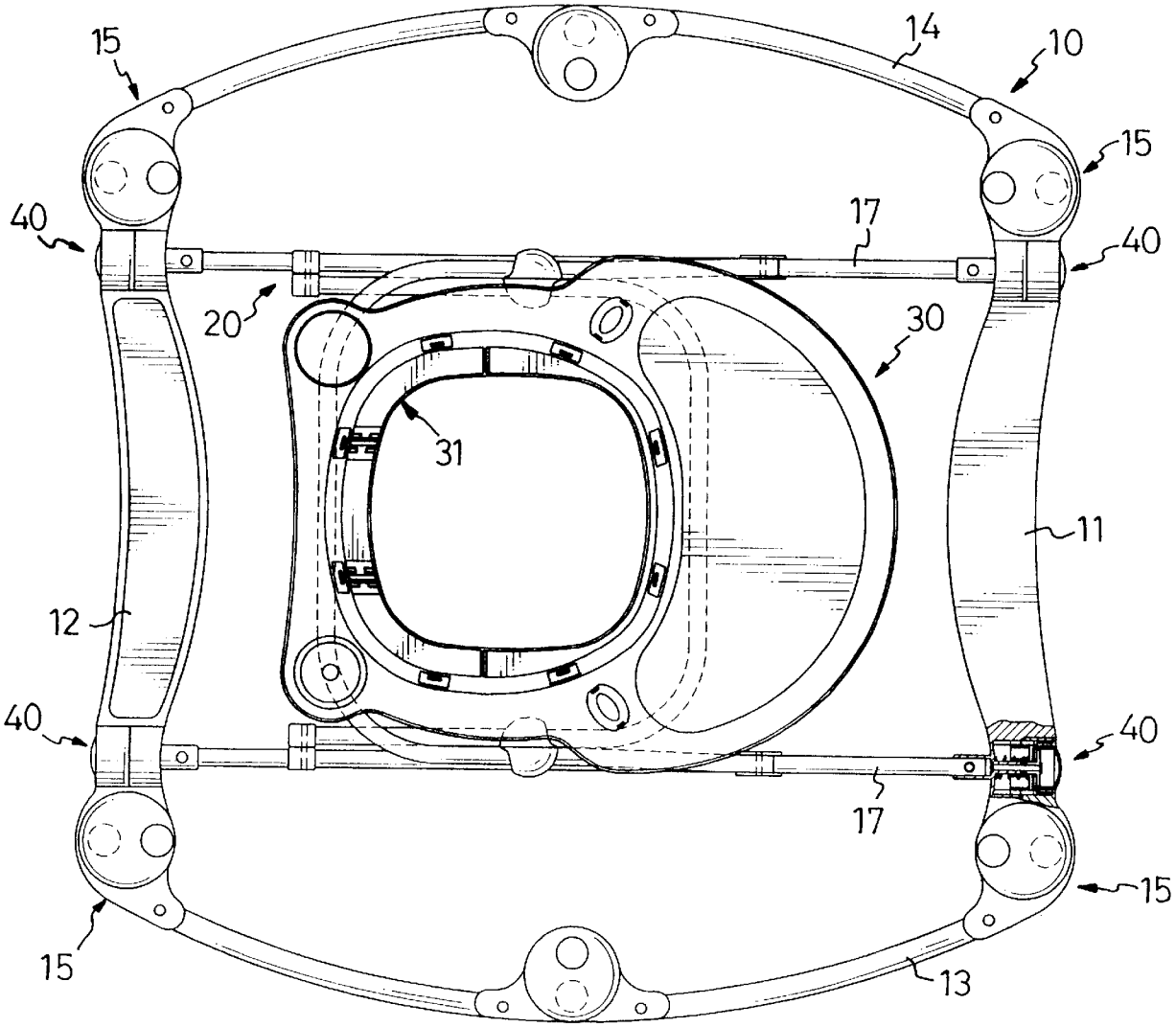
FIG. 2 is a top view of the walking chair as seen in FIG. 1.

Referring to FIG. 1 and FIG. 2, a walking chair 1 comprises a bottom frame 10 having a plurality of wheels 18 rotatably mounted thereto, a supporting frame 20 rigidly mounted onto the bottom frame 10 and a seating device 30 securely mounted onto the supporting frame 20 and having a seat 31 mounted therein. The bottom frame 10 is composed of a front rod 11, a rear rod 12 opposed and spaced apart from the front rod 11 and a pair of arcuate side frames 13, 14. A distal end of each of the arcuate side frames 13, 14 is respectively and pivotally connected with each of a corresponding distal end of the front rod 11 and the rear rod 12 by means of a folding device 15. Furthermore, a connecting rod 17 is securely connected between the corresponding distal ends of the front rod 11 and the rear rod 12.

Because all the folding devices 15 of the invention have the same structure, the folding device 15 which is mounted between the distal end of the front rod 11 and the corresponding distal end of the arcuate side frame 13 is explained as an example.

Figure 3:
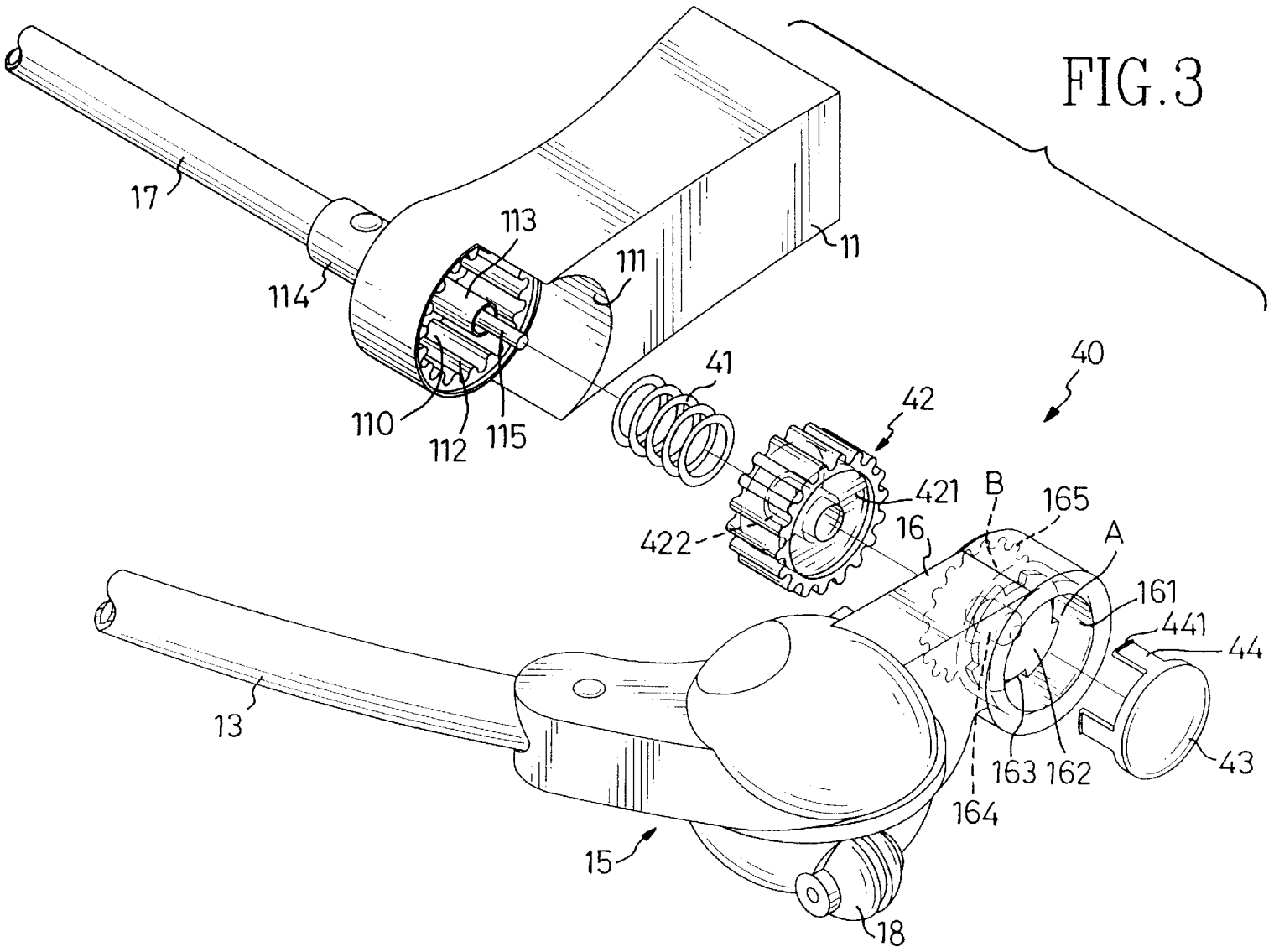
FIG. 3 is an exploded view of a folding device of the present invention.
Figure 4:
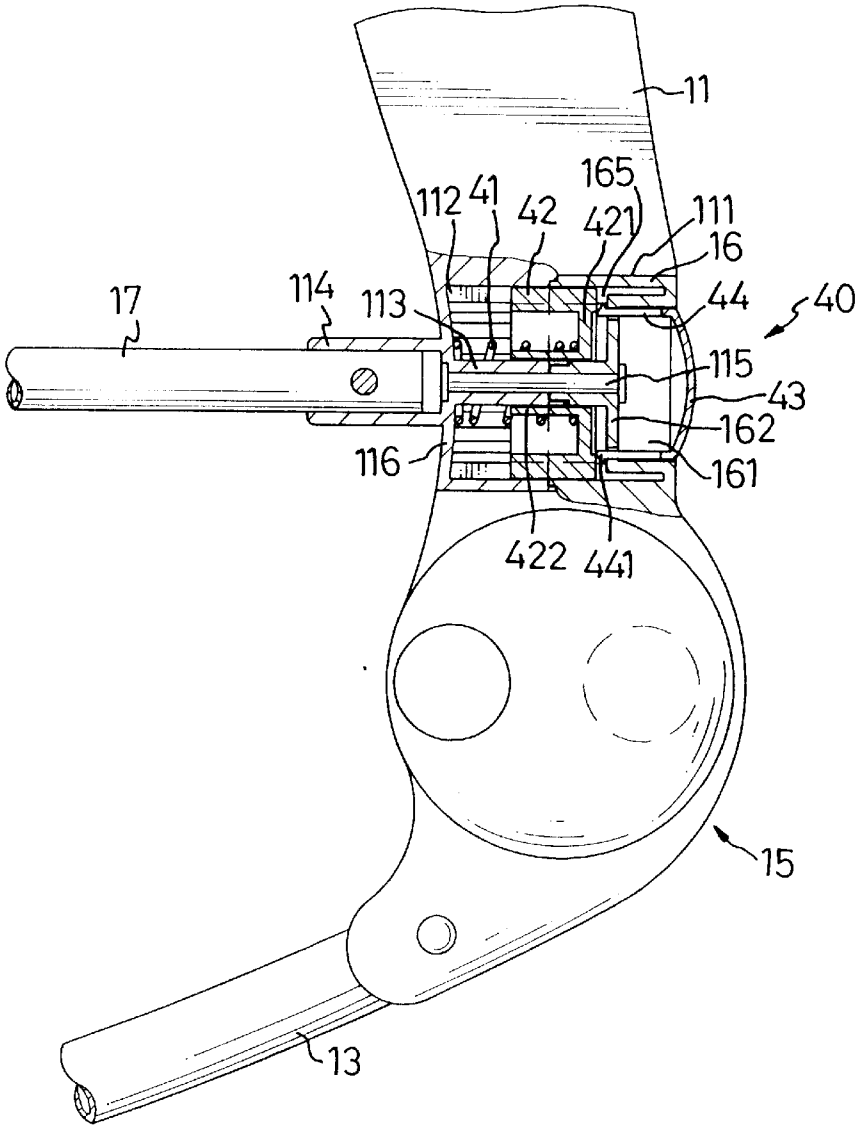
FIG. 4 is a cross sectional view showing a combined structure of the folding device together with a side frame in accordance with the present invention.

Referring to FIGS. 3 and 4, the distal end of the front rod 11 is configured as a front portion and a rear portion. The front portion is tubular and has a passage 110 defined therein by a toothed periphery 112. The rear portion defines a semi-circular recess 111 in communication with a first end of the passage 110. An end wall 116 encrosses a second end of the passage 110. A positioning tube 113 extends from a rear face of the end wall 116 to the first end of the passage 110. The positioning tube 113 defines a longitudinal hole (not numbered) therethrough. A receiving seat 114 extends from a front face of the end wall 116 and away from the passage 110. The receiving seat 114 defines a socket (not shown or numbered) in communication with the longitudinal through hole. The socket receives a distal end of the connecting rod 17. A hollow gear 42 having a length slightly less than a length of the front portion is configured to be meshingly receivable within the toothed periphery of the passage 110. The rear portion has a radius greater than a radius of the hollow gear 42. An end plate 421 formed in the hollow gear 42 defines an open end and a closed end of the hollow gear 42. When the hollow gear 42 is fitted to the front rod 11, the open end of the hollow gear 42 is directed toward the rear face of the end wall 116 of the passage 110. A tubular column 422 extends from a front face of the end plate 421 through the open end of the hollow gear 42 and define a bore (not labeled) therein. A circular recess is defined around the tubular column 422. A spring 41 is received in the tubular recess and around the positioning tube 113 and the tubular column 422 to urge against the end wall 116 and the end plate 421. A end 16 connecting with a distal end of the side rod 13 is configured to have a through hole 161 defined therein and a plate 162 is securely formed in the middle of the through hole 161 to divide the through hole 161 into a first part A and a second part B. The first part A is configured to have a smaller diameter than that of the second part B and a plurality of slits 163 communicating with the first part A and the second part B are defined in a joint of a periphery defining the first part A and the plate 162. A plurality of second toothed periphery 165 corresponding to the toothed periphery 112 and mated with the hollow gear 42 are defined in a periphery defining the second part B. A button 43 having a plurality of extensions 44 is able to be movably received within the first part A of the through hole 161 by means of inserting the extensions 44 respectively into the slits 163 of the plate 162 and the periphery defining the first part A of the through hole 161. Furthermore, each distal end of the extensions 44 has a hook 441 integrally formed therewith, such that when the extensions 44 are inserted into the corresponding slits 163 and abutted to the end plate 421 of the hollow gear 42, the button 43 is able to be positioned in place. It is to be noted especially from FIGS. 3 and 4 that when the folding device 15 of the invention is to be assembled, a positioning member 164 may be provided within the second part B of the through hole 161 to position the shaft 151 therein after the positioning member 164 passes through the hollow gear 42 and that the hooks 441 of each of the extensions 44 of the button 43 are securely abutted the end plate 421 of the hollow gear 42.

Figure 5:
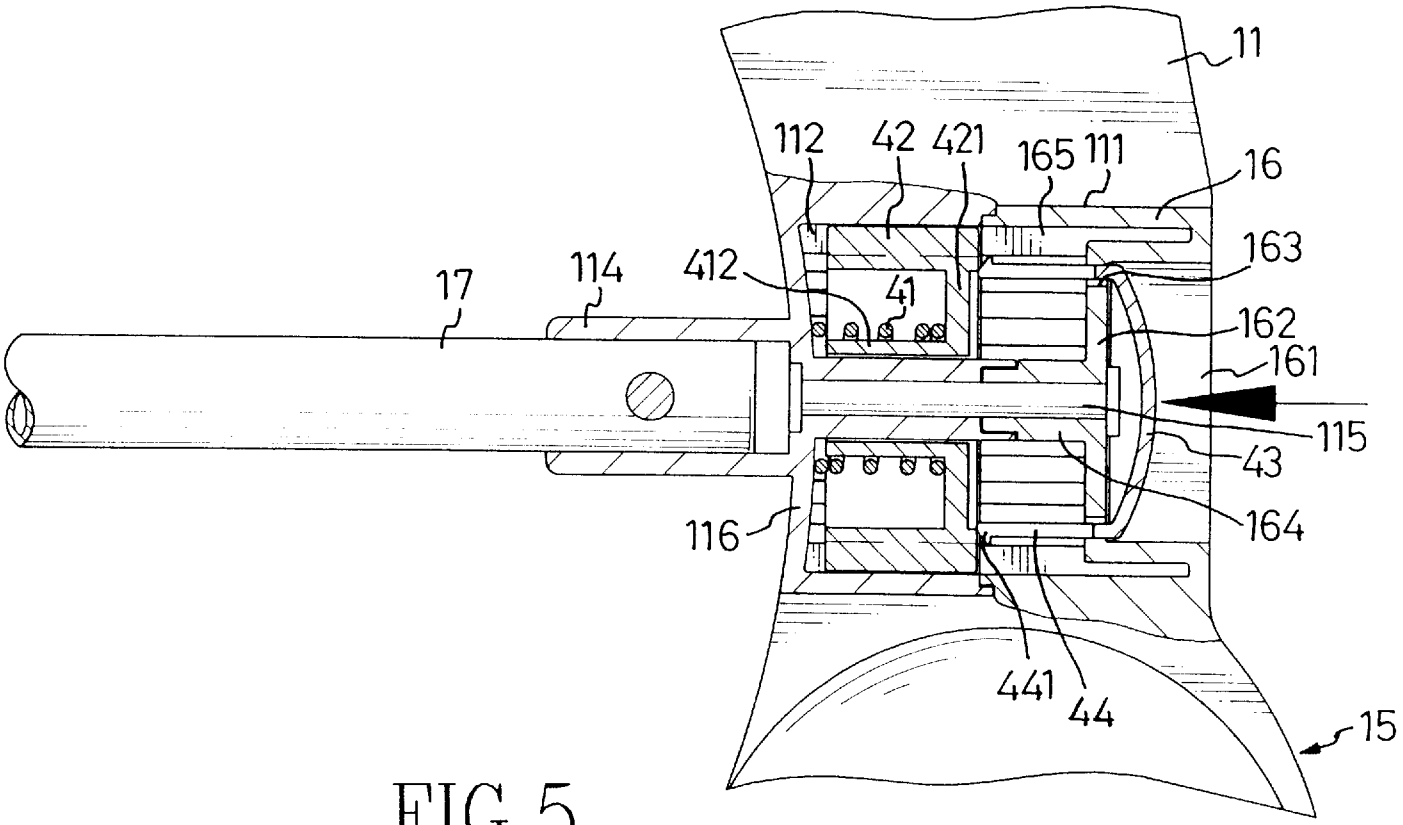
FIG. 5 is a schematic view showing a corresponding movement of a first gear of the folding device caused by the displacement of a button in accordance with the present invention.

Referring to FIGS. 4 and 5, in assembly, the spring 41 is mounted around the tubular column 422 and the hollow gear 42 is fitted to the front portion. The end 16 of the folding device 15 is fitted to the front rod 11 and the shaft 151 is securingly extended between the end wall 116 and the end plate, thereby securely assembling the front rod 11, the hollow gear 42 and the end 16 of the folding device 15. The button 43 is fitted to the end 16. In a first position, as shown in FIG.4, the spring 41 urges the hollow gear 42 to remain in position between a rear portion of the toothed periphery 112 and a front portion of the second toothed periphery 165, thereby retaining the rod 11 and the end 16 in a desired position, i.e., as shown in phantom lines in FIG. 6. In a second position, as shown in FIG. 5, the button 43 is pushed toward the end plate 421, whereby the hollow gear 42 is completely received within the toothed periphery 112 and according engagement between the hollow gear 42 and the second toothed periphery 165 is lost such that the end 16 can be pivoted to the position shown by the solid lines in FIG.6. The button 43 is then released whereby the spring 41 urges the hollow gear 42 back to the first position engaging with both the toothed periphery 112 and the second toothed periphery 165.

Figure 6:
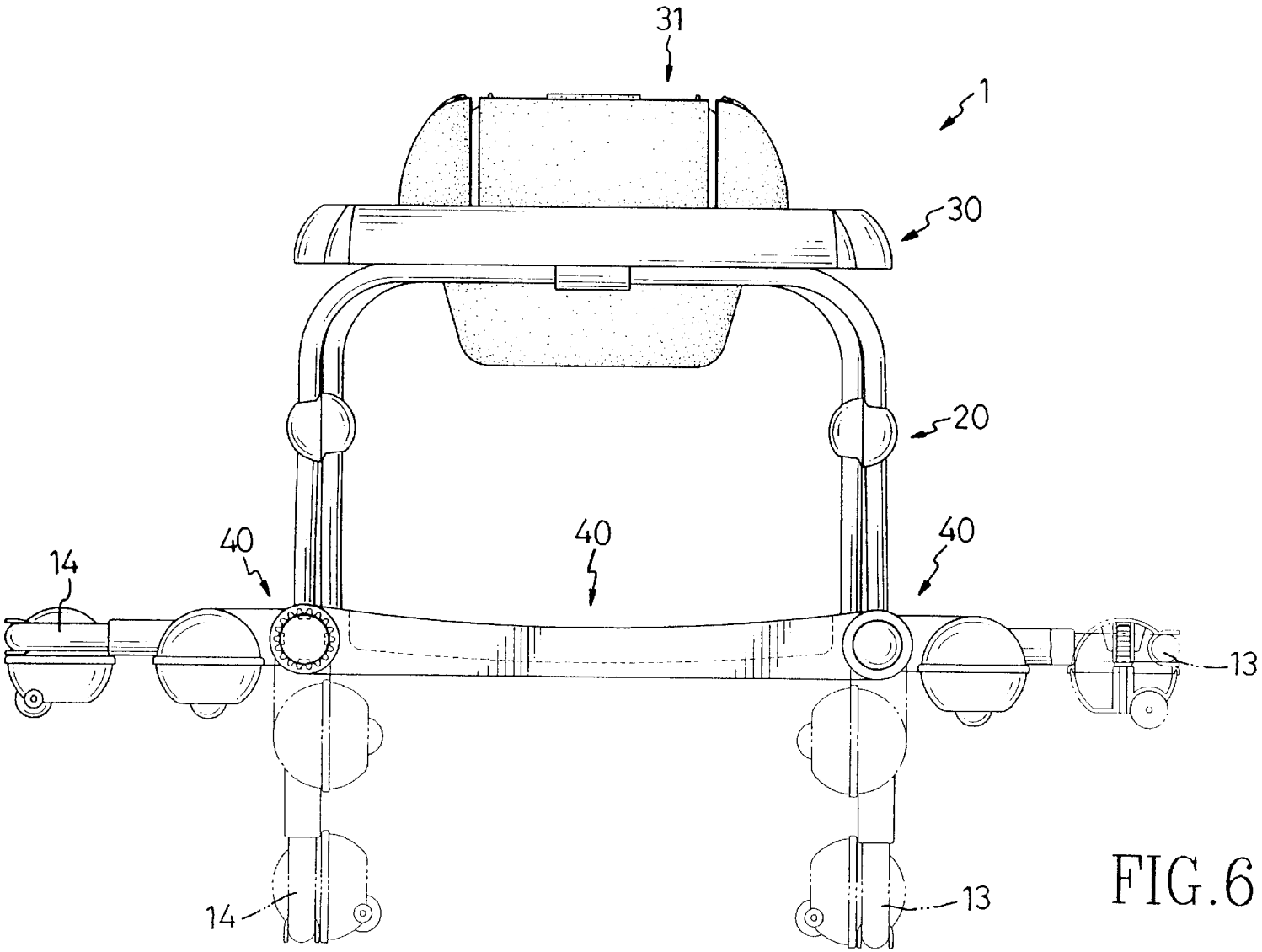
FIG. 6 is a schematic view showing a folding movement of the side frames of the walking chair of the invention.
Figure 7:
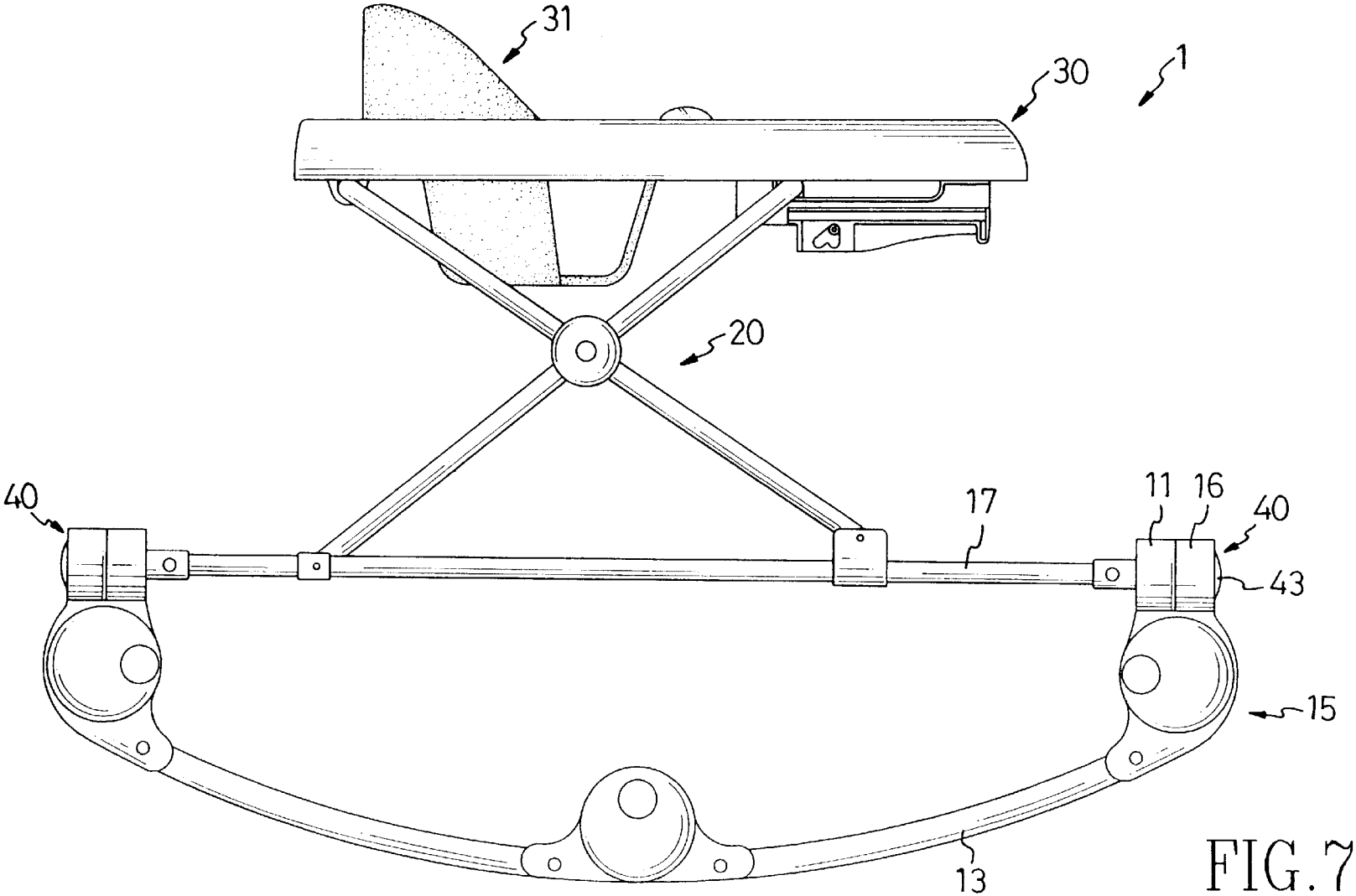
FIG. 7 is a side view showing that the walking chair of the invention is rockable after the side frames are folded downward relative to a seat of the walking chair.

When both of the side frames 13, 14 are folded downward, and the button 43 is released to allow the engagement of the hollow gear 42 with the second toothed 8 periphery 165, the walking chair 1 as seen in FIG. 1 is converted into a rocking chair as shown in FIGS. 6 and 7.

The walking chair of the present invention provides parents a safe structure for a baby to be seated therein and to play therewith and also the walking chair eliminates the expenses of further purchasing a rocking horse.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A walking chair comprising:

a bottom frame having a front rod, a rear rod spaced apart from the front rod, a pair of connecting rods respectively and securely connected between the front rod and the rear rod, a first arcuate side frame pivotally connected between joints of the front rod, the rear rod and the connecting rod and having a plurality of wheels rotatably connected thereto, a second arcuate side frame pivotally connected between joints of the front rod, the rear rod and the connecting rod and having a plurality of wheels connected thereto, a first arcuate side frame, a second arcuate side frame opposed to said first arcuate side frame, a front rod pivotally connected with a first distal end of each of said first arcuate side frame and said second arcuate side frame, and a rear rod pivotally connected with a second distal end of each of said first arcuate side frame and said second arcuate side frame; a supporting frame rigidly mounted onto said bottom frame; and a seating device securely mounted onto said supporting frame and having a seat mounted therein, wherein the improvement comprises: a folding device pivotally connected between joints of said front rod and said first arcuate side frame and said rear rod and said second arcuate side frame, the folding device having a tubular portion provided with a toothed periphery formed in an inner face thereof and a semicircular recess defined in distal ends of said front rod and said rear rod, a positioning tube centrally formed in said tubular portion, a shaft securely inserted into said positioning tube, an end wall encasing an end of said tubular portion, a through hole defined in a distal end of said first arcuate side frame and said second arcuate side frame and having a plate dividing said through hole into a first part and a second part, the second part having a larger diameter than that of said first part and a second toothed periphery integrally formed in a periphery defining said second part, a positioning member extending from said plate to securely receive said shaft therein, a hollow gear mated with said toothed periphery and said second toothed periphery and movably received therebetween and detachably connected with said second toothed periphery and having a tubular column formed therein to be inserted into said positioning tube and to receive said shaft therethrough, a coil spring movably received between said end wall and said end plate, a plurality of slits defined in a joint of said plate and a periphery defining said first part of said through hole, and a button movably received within said first part of said through hole and having a plurality of extensions extending toward said through hole and a plurality of hooks integrally formed at each distal end of said extensions and securely inserted into said slits and abutting said plate.

2. The walking chair as claimed in claim 1, wherein a first end of a connecting rod is securely received in said tubular portion of said front rod, and a second end thereof is securely received in said tubular portion of said rear rod.

3. The walking chair as claimed in claim 1, wherein a receiving seat is formed on said end wall to receive a distal end of said connecting rod.

* * * * *